United States Patent [19]

Yagi

[11] Patent Number: 4,811,448

[45] Date of Patent: Mar. 14, 1989

[54] CLEANING DEVICE FOR A CONTAINER

[76] Inventor: Mikio Yagi, No. 220, Hosoe, Haibara-cho, Haibara-gun, Shizuoka-Ken, Japan

[21] Appl. No.: 106,579

[22] Filed: Oct. 8, 1987

[30] Foreign Application Priority Data

Oct. 13, 1986 [JP] Japan ..... 61-242316

[51] Int. Cl.[4] ..... A47L 17/08

[52] U.S. Cl. ..... 15/211; 15/164; 15/244.1

[58] Field of Search ..... 15/70, 71, 74, 75, 56, 15/73, 164, 211–213, 244 R, 104.92

[56] References Cited

U.S. PATENT DOCUMENTS 2,506,075 5/1950 Fieury ..... 15/244.1 X
3,913,165 10/1975 Behnk ..... 15/211 X
3,934,300 1/1976 Tortorello ..... 15/211

FOREIGN PATENT DOCUMENTS 284666 4/1931 Italy ..... 15/211

*Primary Examiner*—Edward L. Roberts
*Attorney, Agent, or Firm*—Ladas & Parry

[57] ABSTRACT

A cleaning device for a container such as a glass comprises a base, first and second pillars standing from the base, first and second cleaning bodies carried by the first and second pillars, and a third pillar standing from the base in a vicinity of the first cleaning body and extending along the first cleaning body. In use, the container such as a glass is mounted on the cleaning device in such a manner that the inner surface of a wall portion of the container is supported by the first pillar and the outer wall of the diametrically opposing wall portion of the container is supported by the second pillar. The third pillar urges the outer surface of the first mentioned wall portion in the direction of the first pillar and thereby the inner surface and outer surface of the container are pressed against the first and second cleaning bodies. The container is rotated in this state and the inner surface and outer surface of the container is cleaned at the same time by a rubbing action of the first and second cleaning bodies.

4 Claims, 6 Drawing Sheets

CLEANING DEVICE FOR A CONTAINER

BACKGROUND OF THE INVENTION

The present invention generally relates to cleaning devices and more particularly to a cleaning device for cleaning inner and outer surfaces of a container such as a glass by a single cleaning step.

Conventionally, a container such as a glass is cleaned by human hand. The container is held by one hand of a person doing the cleaning, and inner and outer surfaces of the container are cleaned by a cleaning body such as a sponge cleaner held by another hand of the person. In such a cleaning procedure, one has to clean the container twice, by cleaning the inner surface and the outer surface separately. Thus, such a manual cleaning procedure is inefficient and could cause a problem in restaurants and the like where a large number of containers have to be cleaned in a short period of time. Further, fragile containers such as a glass are sometimes chipped or cracked and this could cause a deep cut in the hand of the person doing the cleaning. Therefore, the person doing the cleaning has to concentrate for long periods of time to ensure such accidents to not occur. This also leads to the reduction in the efficiency of the cleaning work. Furthermore, in such a manual cleaning procedure, the bottom of the container tends not to be satisfactorily cleaned particularly when the container to be cleaned is a deep one.

In order to solve such a problem, a dish washing machine is sometimes used. However, a container, particularly a glass, cleaned by such a dish washing machine tend to show spots of detergent on the surface of the container when the container is dried. Thus, it becomes necessary to polish the surface of the glass by a dried cloth or the like to remove such spots. This polishing operation can only be performed by human hand. Therefore, one cannot avoid the similar problems associated with the cleaning by human hand even if one uses a dish washing machine. Further, the glasses cleaned by the dish washing machine tend to be chipped or cracked due to the vibration of the machine. This increases the risk of the person being injured during the removal of the spots of detergent.

A U-shaped cleaning device for cleaning the container is also known in which a wall of the container is held between a pair of legs of the device arranged in a U-shaped configuration. The container is rotated in this state and the container is cleaned by the cleaning bodies carried by the legs of the device. However, such a U-shaped cleaning device has a problem in that the cleaning of the outer surface of the container becomes incomplete when one rotates the container while pressing the container against one of the legs to clean the inner surface. Similarly, the cleaning of the inner surface becomes incomplete when one rotates the container while pressing the container against another leg to clean the outer surface. Thus, it becomes necessary to clean the inner and outer surfaces of the container in two steps, in which the container is at first rotated while being pressed against one of the legs and then rotated while being pressed against the other leg. This obviously reduces the efficiency of the cleaning. In such a U-shaped cleaning device, there is a further disadvantage in that the container is unstable during its rotation as the container is held between the pair of legs by only one wall portion of the container. In other words, the rotary axis of the container is not stable and one has to rotate the container carefully, particularly in case the container is a fragile glass. Because of these reasons, this U-shaped cleaning device is not commonly used.

SUMMARY OF THE INVENTION

Accordingly, it is a general object of the present invention to provide a novel and useful cleaning device in which the problems aforementioned are eliminated.

Another and more specific object of the present invention is to provide a cleaning device of a container such as a glass comprising first and second pillars standing from a base in a generally vertical direction from the base and respectively extending along a contour of inner and outer surfaces of the container to be cleaned, first and second cleaning bodies respectively carried by the first and second pillars for cleaning the inner surface and outer surface of the container, and a third pillar standing from a portion of the base at a vicinity of the first cleaning body in a generally vertical direction and extending along the first cleaning body, in which the first pillar supports the inner surface of a first wall portion of the container mounted on the device for cleaning with the first cleaning body carried by the first pillar intervening between the first pillar and the inner surface, the second pillar supports the outer surface of a second wall portion of the container diametrically opposing to the first wall portion with the second cleaning body intervening between the second pillar and the outer surface, the third pillar presses the outer surface of the first wall portion of the container toward the direction of the first pillar so as to urge the container as a whole toward the first and second cleaning bodies, and the inner and outer surfaces of the container is cleaned by the first and second cleaning bodies which rubs the surfaces as the container mounted on the cleaning device is rotated about the axis of the container. According to the present invention, the container is supported in a stable manner by the first, second and third pillars as it is rotated for cleaning and the inner surface and the outer surface of the container is cleaned by the rubbing action of the first and second cleaning bodies in a single step of operation. Further, the need for urging the container toward the direction of the first and second pillars during the rotation is eliminated. Thus, the device according to the present invention is easy to use and the danger of damaging the container is minimized. The risk of the working person being injured is also minimized accordingly, and the efficiency of the cleaning work is improved. Further, the cleaning device according to the present invention is simple and easily manufactured with little cost.

Other objects and further features of the present invention will be apparent from the following detailed description when read in conjunction with the attached drawings.

DETAILED DESCRIPTION

Figure 1:
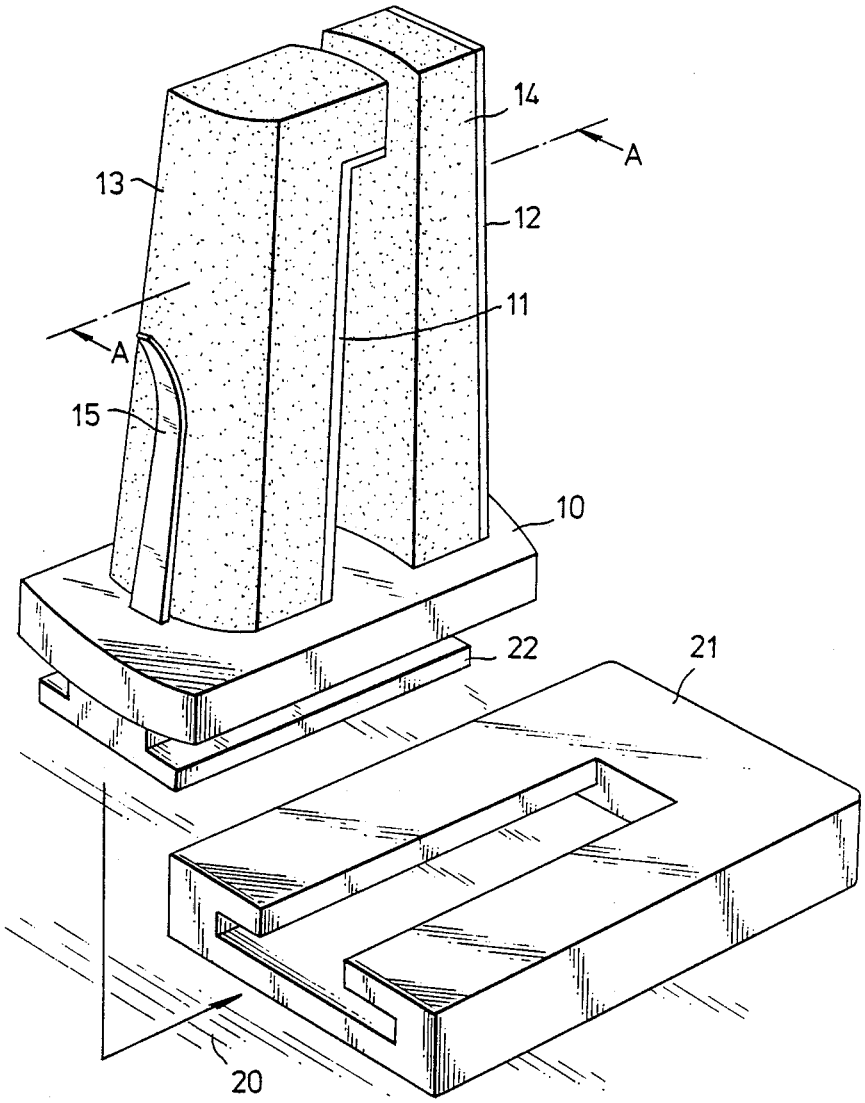
FIG. 1 is a perspective view showing a first embodiment of the cleaning device according to the present invention.

FIG. 1 is a perspective view showing a first embodiment of the cleaning device according to the present invention. In FIG. 1, the cleaning device comprises a first and second resilient pillars 11 and 12 standing from a base 10 in a generally vertical direction to the base and extending along a contour of an inner surface (including a bottom) and an outer surface of a container 16 such as a glass or a plastic cup to be cleaned (not shown in FIG. 1). The pillars 11 and 12 hold on one side first and second elastically deformable cleaning bodies 13 and 14 which contact with the inner and outer surfaces of the container 16 and clean these surfaces. The cleaning bodies are formed from a soft and porous elastic material such as a sponge rubber and the like and absorb a cleaning liquid containing a detergent. As can be seen in the drawing, such cleaning bodies cover one side of the surface of the pillars 11 and 12 completely and extend continuously along the contour of the inner and outer surfaces of the container. Further, a tip of the pillar 11 is bent toward the direction of the pillar 12 at a position generally corresponding to the tip of the pillar 12 along the contour of the container 16. In the present embodiment, the container 16 is a glass having a shape of a truncated cone. When the container 16 is mounted on the pillar 11, the bent portion of the pillar 11 supports a bottom of the glass by the cleaning body 13. The pillars 11 and 12 has a sufficient length such as 10–20 cm depending on the depth of the glass. The pillars 11 and 12 also have a width of several centimeters, for example, sufficient for supporting the inner and outer surface of the container 16 in a stable manner when the glass is rotated for cleaning.

Further, a third resilient pillar 15 stands from the base 10 adjacent to the first cleaning body 13 supporting the inner surface of the container 16 and extends along the cleaning body 13. In other words, the pillar 15 extends along the pillar 11 carrying the cleaning body 13. Preferably, the pillars 11, 12 and 15 are made of plastic material having a sufficient resiliency. Further, it is most advantageous to produce the pillars 11, 12 and 15 together with the base 10 as an integral body by injection molding and the like. The pillar 15 extends for an appropriate distance from the base 10 and the tip of the pillar 15 is curved towards direction away from the cleaning body 13.

It is also preferable to provide a structure 22 at a bottom surface of the base 10 for mounting the base 10 to a mount 21 fixed on a wall 20 in the vicinity of a sink (not shown). In FIG. 1, the structure 22 is shown as a rail slideably engages with a corresponding groove in the mount 21. However, the structure is not limited to such a rail but any known structures such as a suction pad may be used instead. The mount 21 may be fixed on the wall 20 by wall known means such as adhesives or screws.

In order to reinforce the stiffness of the pillar, ribs 31 and 32 may be provided on the pillars 11 and 12 (FIG. 2) according to the need.

In FIG. 1, there are only one each of the pillars 11, 12 and 15. However, the number of the pillars are not limited to one but a plurality of pillars may be used for pillar 11, 12 and 15 according to the size and shape of the container to be cleaned. It is to be understood that such modifications are included within the scope of the present invention.

Figure 2:
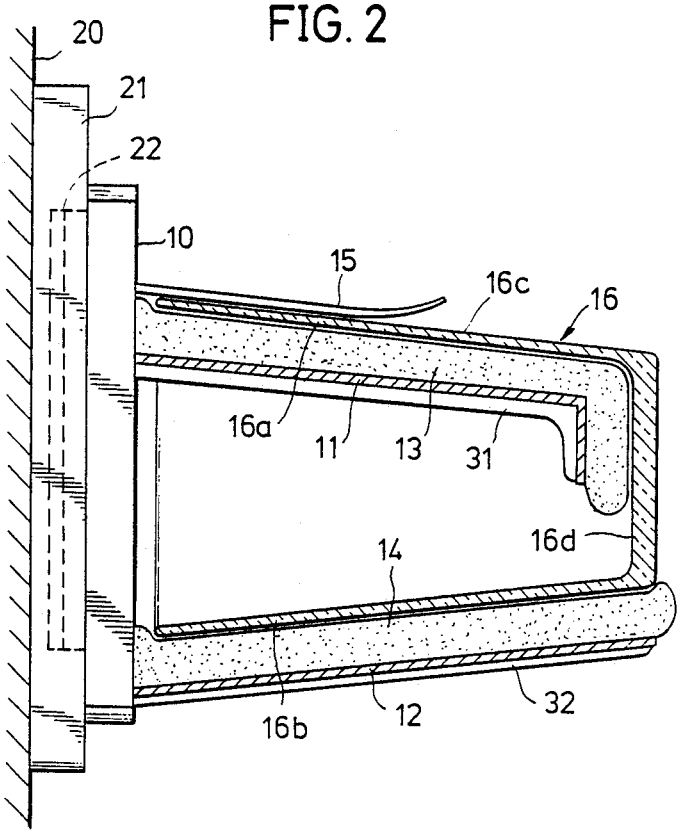
FIG. 2 is a cross sectional view taken along the line A—A in FIG. 1 showing the cleaning device in a state of actual use.

FIG. 2 is a cross sectional view of the cleaning device in FIG. 1 taken along the line A—A and shows the state of the cleaning device in use. In the drawing, the base 10 is mounted on the mount 21 fixed on the vertical wall 20 in the vicinity of the sink (not shown) by the engagement of the structure 22. In use, the container 16 is inserted into the device in such a manner that the outer surface of the first wall portion **16*b* of the container 16 is supported by the second cleaning body 14 carried by the second pillar 12 and a second wall portion 16*a* diametrically opposing to the first wall portion 16*b* is received in a gap between the third pillar 15 and the first pillar 11 carrying the first cleaning body 13. Thus, the pillar 15 presses the outer surface of the second wall portion 16*a* against the cleaning body 13 and urges the container 16 as a whole in a downward direction toward the pillars 11 and 12, thereby the cleaning bodies 13 and 14 are deformed. As the cleaning bodies 13 and 14 are soft elastic body and the pillars 11, 12 and 15 also have sufficient resiliency, the stress and strain caused by the insertion of the container 16 is absorbed and damage to the container is avoided. It should be noted that the tip of the pillar 11 supports a bottom 16*d* of the container 16 by the cleaning body 13** carried thereon.

The cleaning bodies 13 and 14 are soaked with a cleaning liquid containing a detergent, and the container 16 is rotated around its axis on the cleaning device. As a result, the first cleaning body 13 rubs the inner surface and the bottom of the container 16 and the second cleaning body 14 rubs the outer surface of the container 16. Thus, the cleaning device according to the present invention cleans the inner surface of the container 16 including the bottom and the outer surface of the container 16 in a single step of operation by rotating the container mounted on the cleaning device, thereby the necessity of applying force to the container by a human hand is eliminated. In other words, the pillar 15 of the cleaning device of the present invention applies a strong urging force to the container 16 toward the direction of the cleaning bodies 13 and 14. Therefore, a person doing the cleaning work is relieved from the exhausting work of urging the container 16 toward the cleaning bodies. In the case the pillar 15 is not provided, the person has to urge the container toward the cleaning bodies for each container to be cleaned. In such a case that a large amount of containers have to be cleaned, it is difficult to control the force repeatedly for a prolonged time period due to the fatigue of the person and there is a danger that the container is damaged and the person is injured by making a mistake, particularly if the container is a thin walled glass. The cleaning device according to the present invention avoids such a problem by using the pillar 15.

In the cleaning device according to the present invention, a bottom **16*d* of the container 16 is rubbed by the cleaning body 13 so that the cleaning of the bottom is complete as opposed to the conventional manual cleaning method in which the bottom tends not to be completely cleaned. The container 16 is rotated in a stable manner as the container is supported at the inner and outer surfaces as well as at the bottom by the pillars 11, 12 and 15**. Thus, the cleaning work becomes easy and the danger of the accident is minimized, thereby the efficiency of the cleaning work is greatly increased.

In case a shallow container is to be cleaned, the wall of the container covers only the upper portion of the cleaning bodies 13 and 14 when the container is mounted on the cleaning device. In such a case one can use a relatively long pillar 15 to urge the container wall. In other words, the length of the pillar 15 should be chosen to be sufficiently long in order that the cleaning device is used also effectively in such cases.

Figure 3:
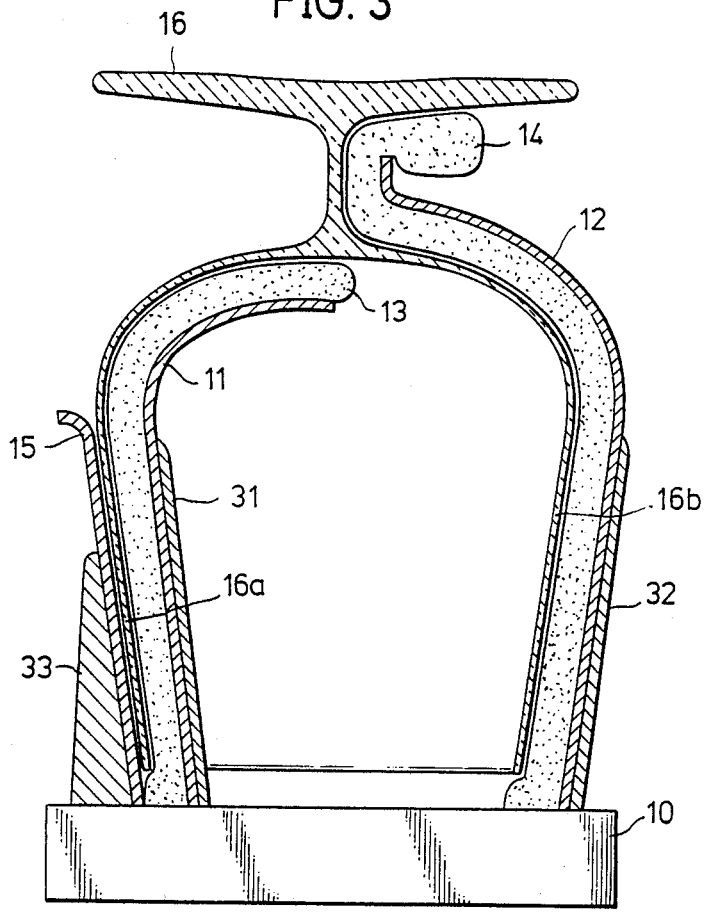
FIG. 3 is a cross sectional view similar to FIG. 2 showing a modification of the cleaning device of FIG. 1.

FIG. 3 shows a modification of the cleaning device of FIG. 1 in which the cleaning device is adapted to such a container as a wine glass having a curved surface In FIG. 3, those parts corresponding to the parts shown in FIGS. 1 and 2 are given identical reference numerals and the descriptions thereof will be omitted. In the modification of FIG. 3, the first pillar 11 extends along the contour of the curved inner surface of a wine glass 16 and the cleaning body 13 supports the inner surface of a first wall portion 16*a* of the wine glass 16. The second pillar 12 extends along the contour of the curved outer surface of the glass and the cleaning body 14 supports the outer surface of the second wall portion 16*b* opposing diametrically to the first wall portion 16*a*. In FIG. 3, the structure for mounting the base 10 on the wall is omitted for simplicity. In mounting the glass 16 on the cleaning device, the second wall portion 16*b* of the wine glass 16 is inserted into a gap formed between the cleaning bodies 13 and 14 adjacent to the tip of the pillar 11, and the first wall portion 16*a* diametrically opposing the second wall portion 16*b* is received into a gap between the first pillar 12 and the third pillar 15. The pillar 15 presses the outer surface of the second wall portion 16*a* as is the case of FIG. 2, thereby the wine glass 16 is urged as a whole toward the direction of the pillars 11 and 12. Thus, the inner surface and the outer surface of the wine glass is strongly urged to the cleaning bodies 13 and 14. Thereby, the danger of the thin walled wine glass being damaged by the stress is minimized as the cleaning bodies 13 and 14 are made of elastically deformable material such as a sponge rubber and the pillars 11, 12 and 15 are made of resilient material having an appropriate elasticity. It is also possible to provide reinforcing ribs 31, 32 and 33 for reinforcing the stiffness of the pillars 11, 12 and 15 if desired. By rotating the wine glass thus mounted on the cleaning device, the cleaning bodies 13 and 14 soaked with the liquid containing detergent rub the inner and outer surfaces of the glass and clean the dirt on these surfaces effectively.

Figure 4:
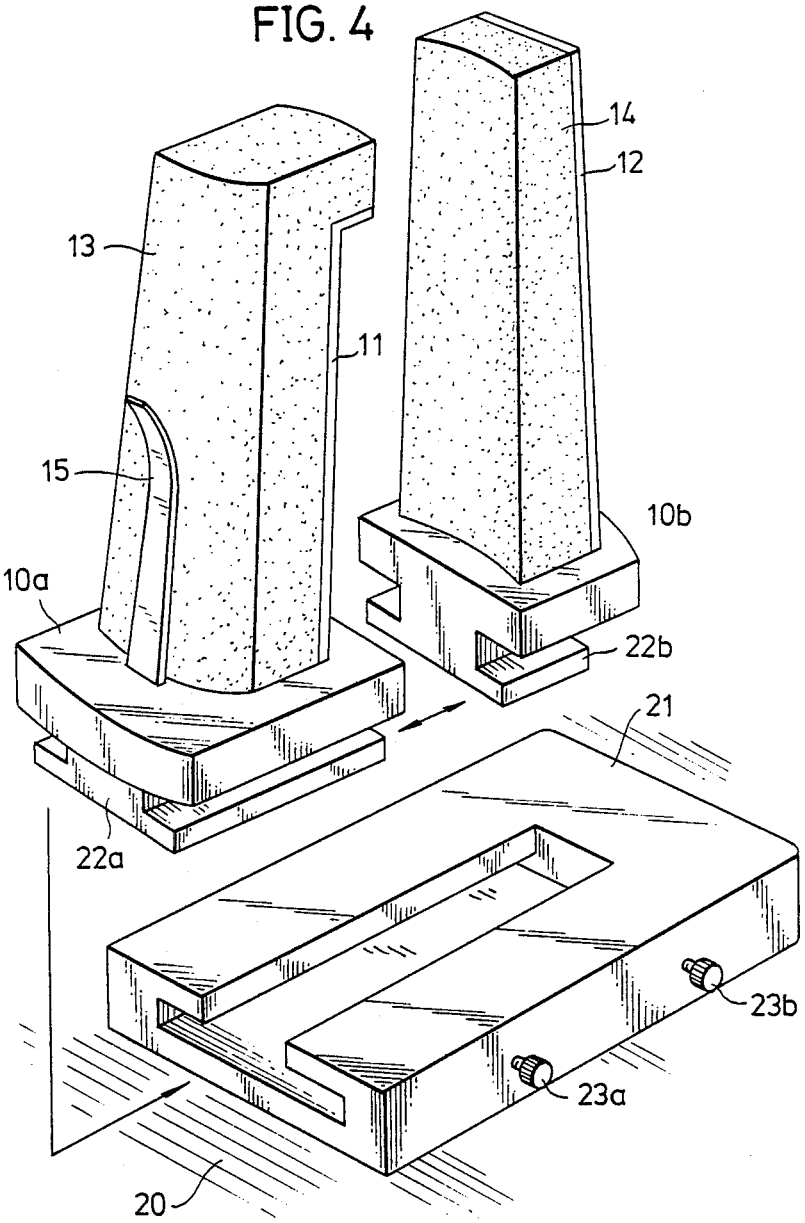
FIG. 4 is a perspective view showing a second embodiment of the cleaning device according to the present invention.

FIG. 4 shows another embodiment of the cleaning device according to the present invention. In the drawing, those parts corresponding to the parts in FIG. 1 are given the identical reference numerals and the descriptions thereof will be omitted.

In the cleaning device in FIG. 4, it is noted that the base 10 is made of two base parts 10*a* and 10*b*, and the base parts 10*a* and 10*b* are mounted on the mount 21 in a slidable manner so that the distance between the base part 10*a* and the base part 10*b* is adjustable. The first base part 10*a* carries the pillar 11 carrying the cleaning body 13 as well as the pillar 15, and the second base part 10*b* carries the pillar 12 carrying the cleaning body 14. In FIG. 4, the two base parts 10*a* and 10*b* are mounted in the common mount 21 in a slideable manner by rail portions 22*a* and 22*b* engaged in a corresponding groove in the mount 21. It is to be understood that the mounting of the base parts 10*a* and 10*b* on the mount 21 is not limited to such a rail and a groove mechanism, but any known means allowing the adjustment of the separation between the base parts 10*a* and 10*b* may be used.

By constructing the base parts 10*a* and 10*b* in a slideable manner, the separation between the pillars 11 and 12 may be adjusted according to the size (diameter) of the container. Thus, the cleaning device of the present invention can be used for containers having various sizes. The pillars 11 and 12 are fixed at a desired position by mans of a screw and the like shown schematically by the reference numerals 23*a* and 23*b*.

Figure 5A:
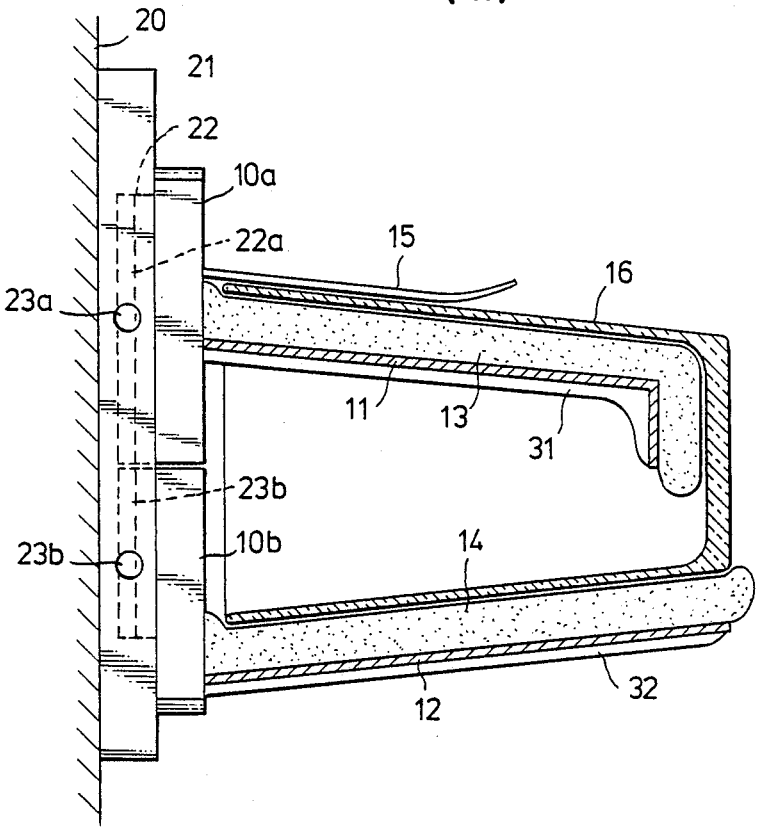
FIGS. 5(A) and (B) are cross sectional views respectively showing the state of the use of the cleaning device of FIG. 4.
Figure 5B:
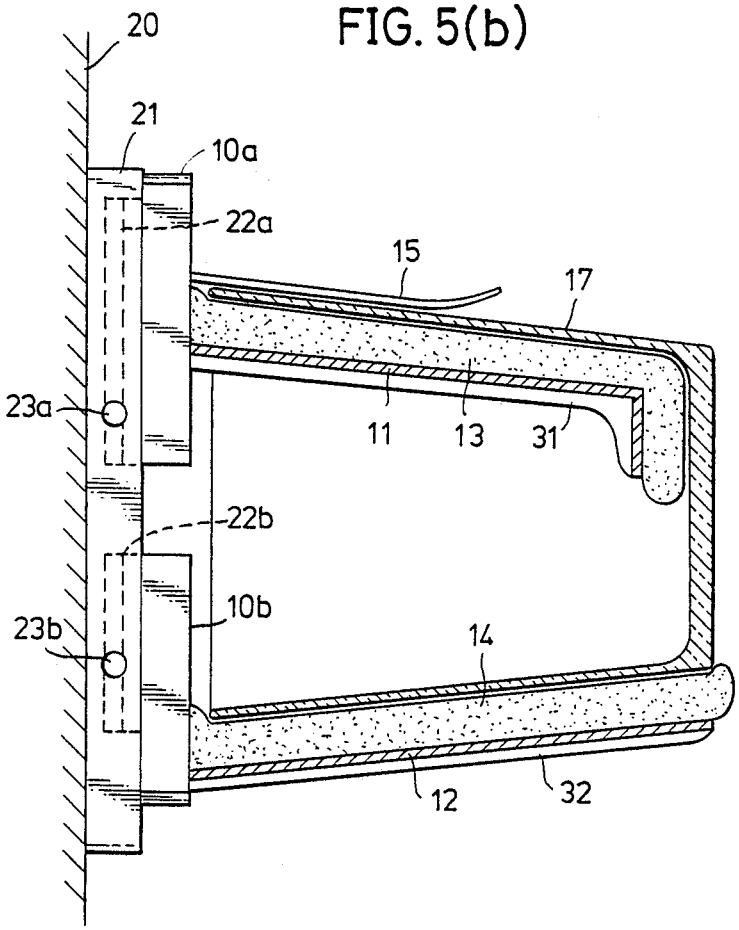

FIGS. 5(A) and (B) show the cross sectional view of the cleaning device of FIG. 4 in two different states in which a container having a relatively small size and a container having a relatively large size are mounted, respectively. In the drawing, those parts constructed identically to those corresponding parts in FIG. 2 are given the identical reference numerals and the descriptions thereof will be omitted. The base parts 10*a* and 10*b* are slideably engaged with the mount 21 fixed on the wall 20 similarly to the case of FIG. 2 and are fixed at appropriate positions by arbitrary means such as screws 23*a* and 23*b* as shown in FIG. 4. FIG. 5(A) shows a state in which the cleaning device is mounted with a container 16 having a similar size to the container shown in FIG. 2. In this case, the base parts 10*a* and 10*b* are fixed to each other at a closest position by the screws 23*a* and 23*b*. In this state, the container 16 is rotated and the inner surface, outer surface, and the bottom of the container 16 are cleaned by the cleaning bodies 13 and 14 as described. FIG. 5(B) shows the cleaning device in the state in which a container 17 having a large diameter to the container 16 in FIG. 5(A) is mounted. In FIG. 5(B), the cleaning device is adapted to the container 17 such that the base parts 10*a* and 10*b* are separated from each other by an appropriate distance and fixed on the mount 21 by the screws 23*a* and 23*b*. The mount 21 is fixed on the wall 20 by using adhesives and the like.

The cleaning device according to the present invention is mounted on a convenient wall surface in the vicinity of the sink of the kitchen in a detachable manner. Therefore, the whole set of the cleaning device including the base 10 or the base parts 10*a* and 10*b*, the pillars 11, 12 and 15 and the cleaning bodies 13 and 14 is easily exchanged for a new one when the cleaning bodies 13 and 14 are worn out by use.

Further, various changes and modifications may be made within the scope of the present invention.

What is claimed is:

1. A cleaning device for cleaning a container such as a glass mounted thereon comprising:

a base;

first and second pillars standing on the base in a generally vertical direction to the base and respectively extending along contours of inner and outer surfaces of the container to be cleaned;

first and second elastically deformable soft sponge cleaners respectively carried by the first and second pillars for cleaning the inner surface and the outer surface of the container, said first sponge cleaner being carried by the first pillar along a surface facing away from the second pillar and said second sponge cleaner being carried on the second pillar along a surface facing the first pillar;

a third pillar standing on the base in a generally vertical direction to the base in vicinity of the first sponge cleaner carried by the first pillar and extending along the first cleaning body at a side far from the second pillar with reference to the first pillar, said third having a tip portion curving away from the first sponge cleaner; and wherein said first, second and third pillars are formed as an integral body together with said base from a resilient plastic material, and said first pillar supporting the inner surface of a first wall portion of the container mounted on the cleaning device for cleaning by said first sponge cleaner, said second pillar supporting the outer surface of a second wall portion which diametrically opposes said first wall portion of the container mounted on the cleaning device for cleaning by said second sponge cleaner, said third pillar engages the outer surface of said first wall portion of the container mounted on the cleaning device to urge the container in the direction of said first and second sponge cleaners, the cleaning device cleaning the inner and outer surfaces of the container by said first and second sponge cleaners as the container mounted on the cleaning device is rotated.

2. A cleaning device as claimed in claim 1 in which said base is provided at its bottom surface with means for detachably mounting the base on a wall.

3. A cleaning device as claimed in claim 1 in which said first, second and third pillars are provided with reinforcing ribs for increasing the stiffness of the pillars.

4. A cleaning device for cleaning a container such as a glass mounted thereon comprising:

a base;

first and second pillars standing on the base in a generally vertical direction to the base and respectively extending along contours of inner and outer surfaces of the container to be cleaned;

first and second elastically deformable soft sponge cleaners respectively carried by the first and second pillars for cleaning the inner surface and the outer surface of the container, said first sponge cleaner being carried by the first pillar along a surface facing away from the second pillar and said second sponge cleaner being carried on the second pillar along a surface facing the first pillar;

a third pillar standing on the base in a generally vertical direction to the base in vicinity of the first sponge cleaner carried by the first pillar and extending along the first cleaning body at a side far from the second pillar with reference to the first pillar, said third pillar having a tip portion curving away from the first sponge cleaner; and wherein said base comprises a first base portion carrying said first and third pillars and a second base portion carrying said second pillar, said first and second base portions having means for detachably mounting the base portions on a wall so that the distance between the first and second base portions is adjustable; and said first pillar supporting the inner surface of a first wall portion of the container mounted on the cleaning device for cleaning by said first sponge cleaner, said second pillar supporting the outer surface of a second wall portion which diametrically opposes said first wall portion of the container mounted on the cleaning device for cleaning by said second sponge cleaner, said third pillar engages the outer surface of said first wall portion of the container mounted on the cleaning device to urge the container in the direction of said first and second sponge cleaners, the cleaning device cleaning the inner and outer surfaces of the container by said first and second sponge cleaners as the container mounted on the cleaning device is rotated.

* * * * *